United States Patent [19]

Cegielski et al.

[11] Patent Number: 4,475,600

[45] Date of Patent: Oct. 9, 1984

[54] SUBSEA WELL COMPLETION APPARATUS

[75] Inventors: Eugene J. Cegielski; Robert L. Wilkins, both of Houston, Tex.

[73] Assignee: Cameron Iron Works, Inc., Houston, Tex.

[21] Appl. No.: 365,272

[22] Filed: Apr. 5, 1982

[51] Int. Cl.[3] ..... E21B 43/013

[52] U.S. Cl. ..... 166/344; 166/356; 166/368

[58] Field of Search ..... 166/368, 365, 344, 347, 166/348, 360, 341, 356, 75 A, 75 R, 96, 383, 384, 313; 175/7

[56] References Cited

U.S. PATENT DOCUMENTS

| | | | |
|---|---|---|---|
| 344,137 | 6/1886 | Royce | 166/75 A |
| 2,988,144 | 6/1961 | Conrad | 166/356 |
| 3,142,344 | 7/1964 | Otteman et al. | 166/359 |
| 3,171,674 | 3/1965 | Bickel et al. | 166/368 |
| 3,191,696 | 6/1965 | Pollard et al. | 175/7 |
| 3,312,282 | 4/1967 | Yetman | 166/383 |
| 3,334,690 | 8/1967 | Garrett | 166/384 |
| 3,461,957 | 8/1969 | West | 166/368 |
| 3,656,549 | 4/1972 | Holbert, Jr. et al. | 166/356 |
| 3,770,053 | 11/1973 | Martin et al. | 166/365 |
| 3,835,929 | 9/1974 | Suman, Jr. | 166/75 |
| 4,240,506 | 12/1980 | Dareing | 166/367 |
| 4,411,317 | 10/1983 | Gieswein | 166/347 |

*Primary Examiner*—Stephen J. Novosad
*Assistant Examiner*—Hoang C. Dang
*Attorney, Agent, or Firm*—Vinson & Elkins

[57] ABSTRACT

A completion system or tree system for a subsea well having an anchor base on bottom surrounding a well bore, a conductor pipe lining the upper end of the well bore and connecting to the anchor base, a guide base landed on the anchor base and having an upwardly facing funnel positioned in the opening of the anchor base, and a production string extending through the conductor pipe and bending to a substantially horizontal position slightly above the guide base with the start of its gradual bend being below the funnel and with sharp bend production tubing bending immediately avove the funnel since no high profile guide base is present on the anchor base.

6 Claims, 5 Drawing Figures

SUBSEA WELL COMPLETION APPARATUS

BACKGROUND

Subsea wells are expensive to drill and install completion equipment. In cold climates and shallow water some problems have been encountered due to damage to the subsea wellhead equipment due to iceberg scouring and as a result of anchors, anchor lines and fishing nets, lines and equipment being dragged over a subsea wellhead.

Efforts have been made to protect subsea wellheads by excavating the bottom, placing the wellhead equipment in the excavation and providing domed cover to be placed over the wellhead to protect it. This type of solution is shown in U.S. Pat. No. 3,247,672. Several different structures have provided for removable guide bases as shown in U.S. Pat. Nos. 3,464,489, 3,559,754 and 3,321,015. Such patents do not suggest a low profile tree system and do not teach or suggest any height reduction by the removal of the guide base.

SUMMARY

The present invention relates to an improved low profile subsea well completion system which includes an anchor base with a large diameter conductor pipe landed thereon and cemented in the well bore, an upwardly facing funnel supported on said base, production tubing extending upwardly in conductor pipe and bending to a substantially horizontal position for its connection to flowline connector. The production tubing may start its bend at a position below the funnel or immediately thereabove whereby the flowline and other completion equipment are mounted close to the anchor base.

An object of the present invention is to provide an improved subsea well completion apparatus which is less likely to be damaged by anchors, anchor lines or fishing nets.

A further object is to provide an improved subsea well completion apparatus which has a low profile to avoid iceberg damage.

Still another object is to provide an improved subsea well completion apparatus which is economical.

BRIEF DESCRIPTION OF THE DRAWINGS

These and other objects, features and advantages are hereinafter set forth and explained with respect to the drawings wherein.

DESCRIPTION OF THE PREFERRED EMBODIMENT

Figure 1:
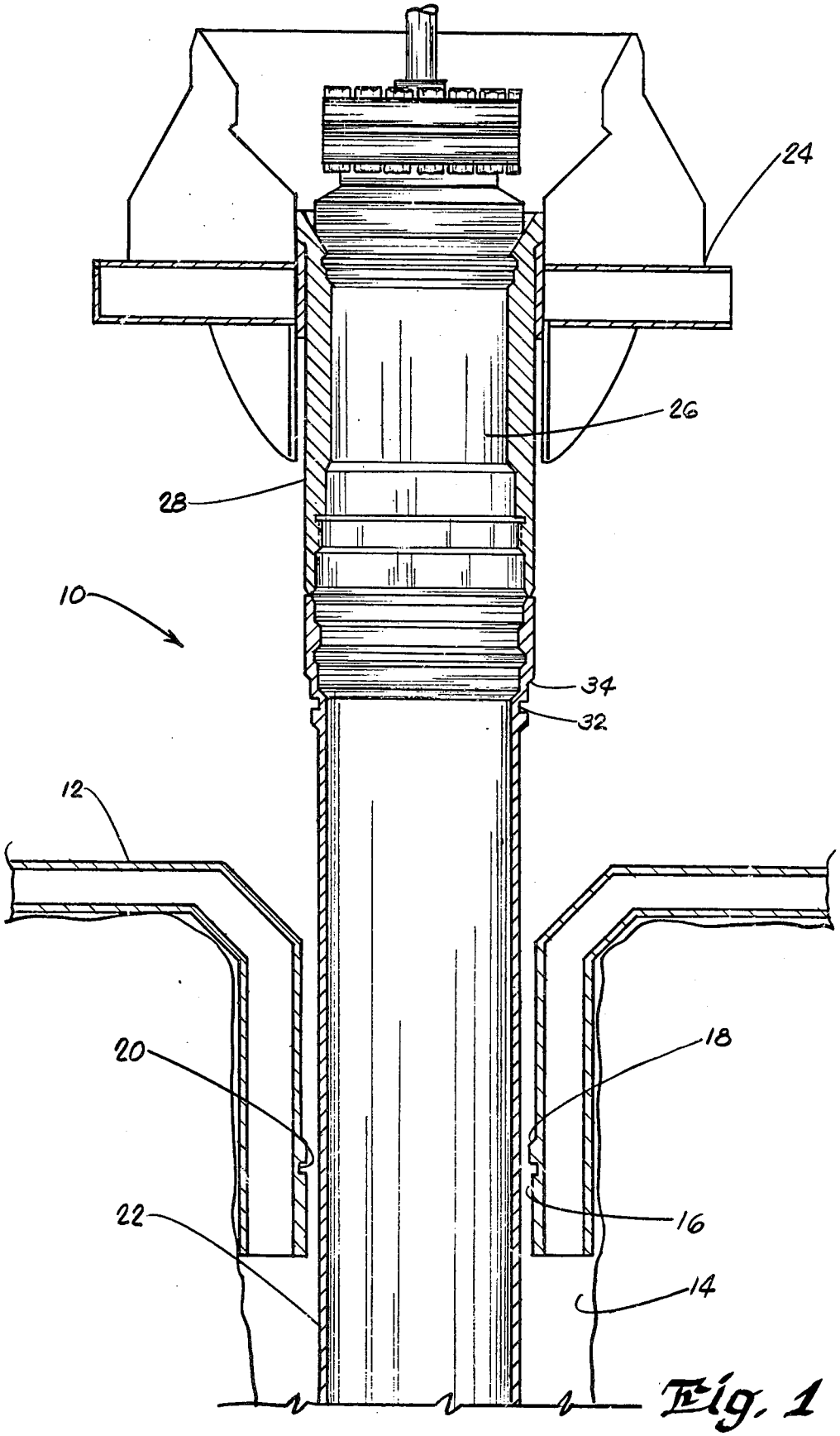
FIG. 1 is a sectional view of a subsea well with the conductor pipe and retrievable guide base being lowered therein.
Figure 2:
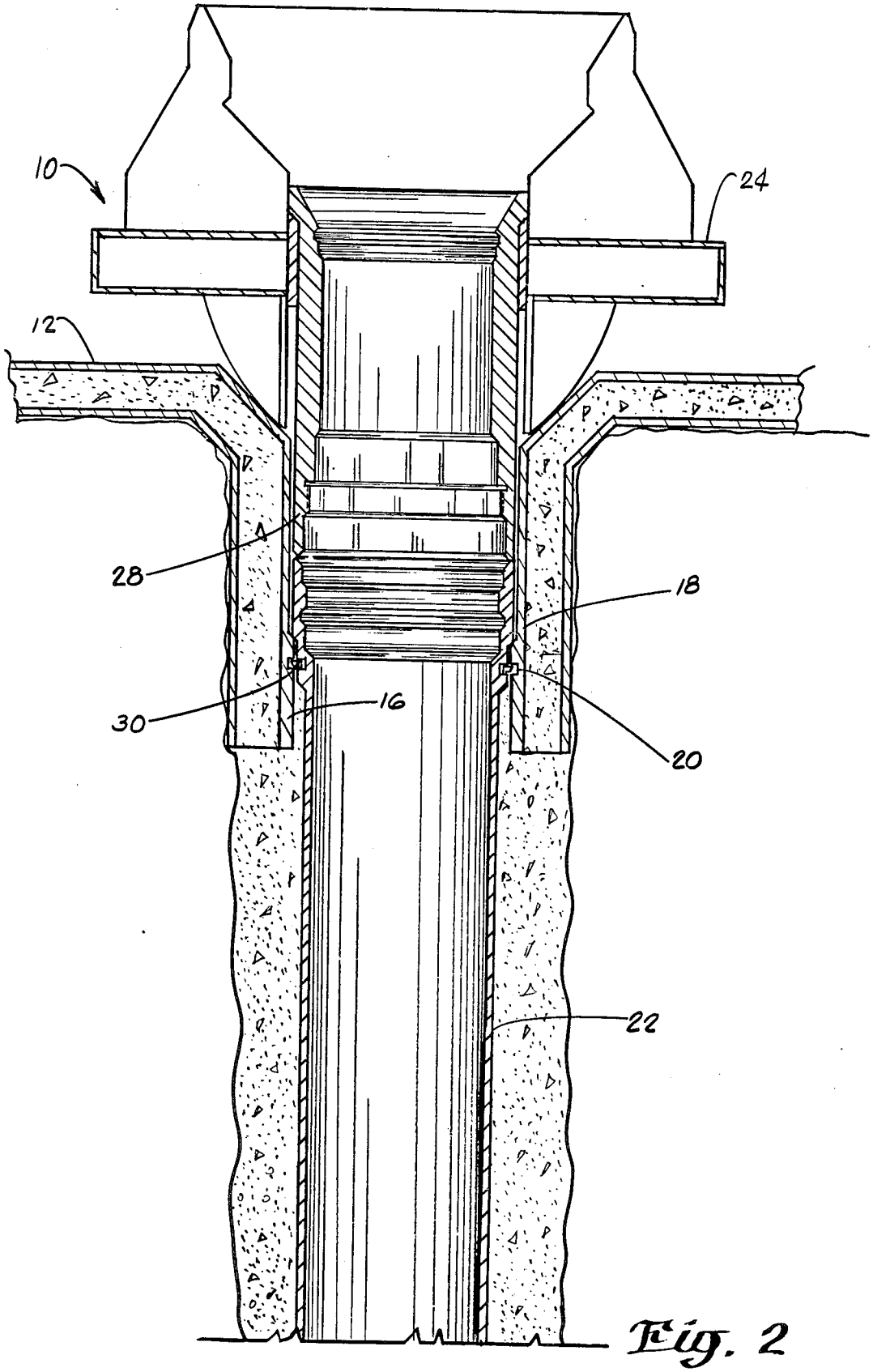
FIG. 2 is a similar view with the conductor pipe landed on the internal shoulder on the anchor base and the gussets of the retrievable guide base seated on the anchor base.

Subsea well 10 has anchor base 12 landed around the upper end of well bore 14 and has its connector neck 16 extending downward in well bore 14. Neck 16 includes internal landing seat 18 and locking groove 20 below seat 18. Conductor pipe 22 and retrievable high profile guide base 24 are run as shown in FIG. 1 into well 10 on running tool 26. After conductor pipe 22 and anchor base 12 have been cemented in well bore 14 a suitable releasable connecting means (not shown) connects the interiors of conductor pipe 22 and housing 28 of guide base 24.

Figure 3A:
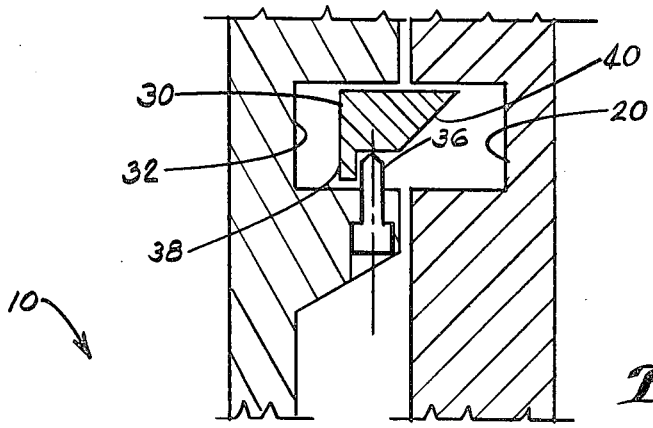
FIG. 3 is another similar view showing the retrievable guide base removed and FIG. 3A illustrates the conductor pipe locking ring.
Figure 3:
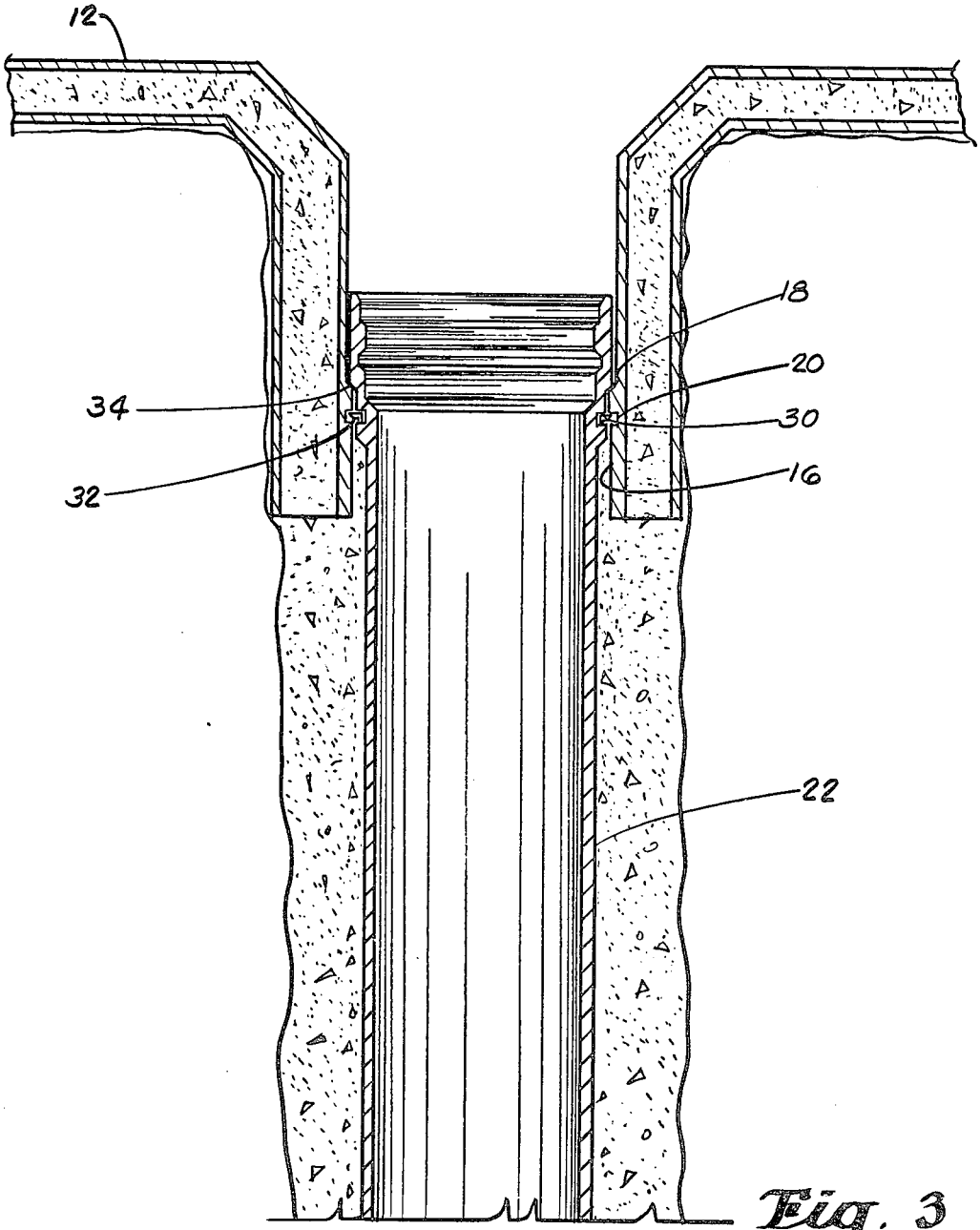

After drilling is completed retrievable guide base 24 and its housing 28 are released from conductor pipe 22 and retrieved. This leaves well 10 as shown in FIG. 3. Locking ring 30 is positioned in external groove 32 immediately below landing shoulder 34 on conductor pipe 22 and pin 36 engages rim 38 on split locking ring 30 to retain ring 30 in groove 32. In its normal position ring 30 extends outward of the exterior of conductor pipe 22 to engage in groove 20 in anchor base 12 as shown in FIG. 3A. Outer periphery 40 of ring 30 is tapered upwardly and outwardly as shown in FIG. 3A so that as conductor pipe 22 is lowered through landing seat 18 on anchor base 12 ring 30 is cammed inward into groove 32. Upon groove 32 registering with groove 20, ring 30 moves resiliently outward to be partly in each of said grooves. In this position conductor pipe 22 is locked to anchor base 14.

Figure 4:
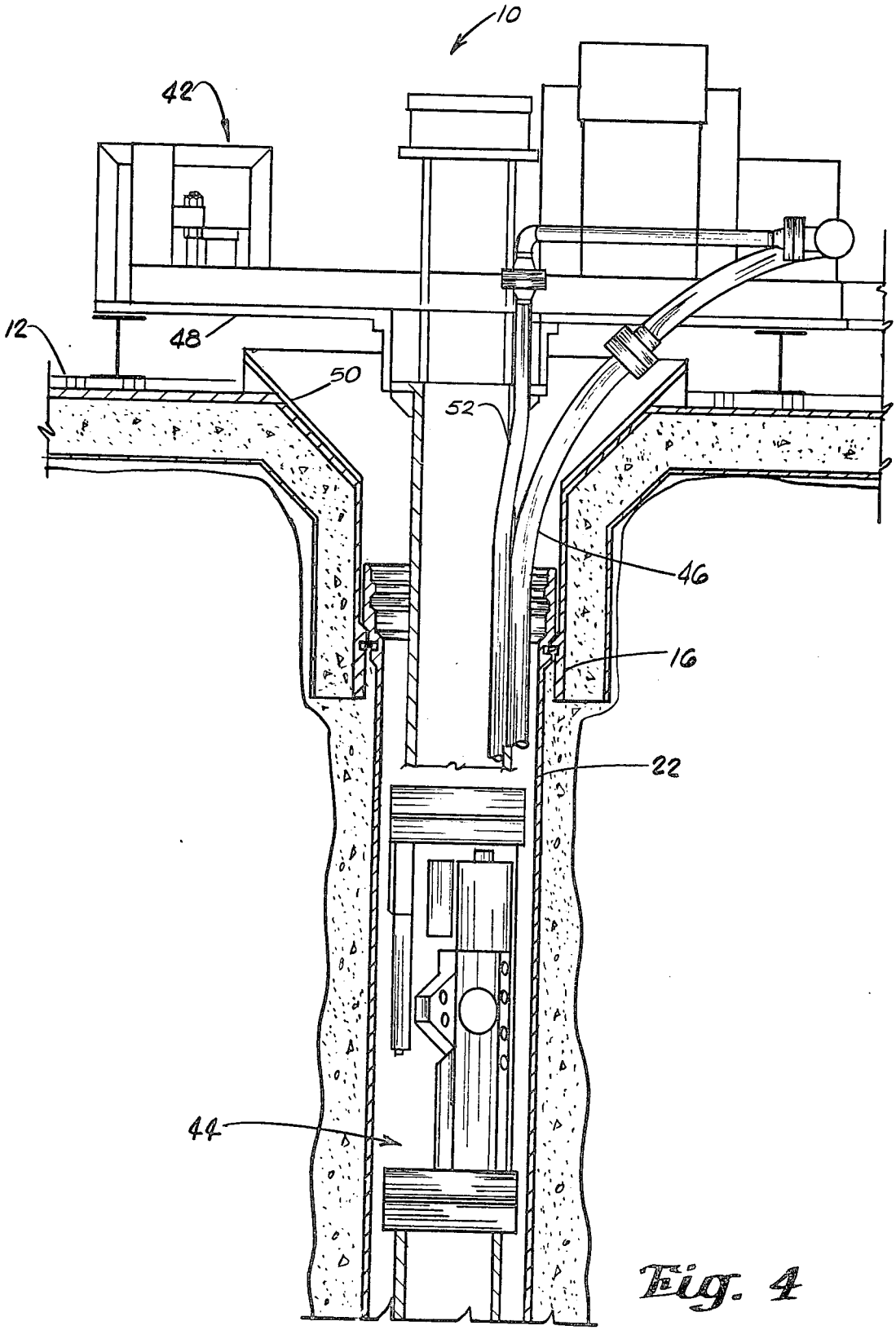
FIG. 4 is another similar view showing the permanent funnel up guide base landed on the anchor base and with the other completion equipment, including production taking and downhole equipment landed in the anchor base.

Production equipment 42 shown in FIG. 4 is landed on anchor base 12 and downhole tree equipment 44 is lowered into conductor pipe 22 so that production tubing strings 46 start their bend within a conductor pipe 22 and through low profile funnel up guide base 48. Funnel 50 is positioned within the central opening of anchor base 12 as shown. This allows the flowline connector (not shown) to be positioned relatively low on base 48 since production tubing strings 46 reach their horizontal position slightly above the upper surface of base 48. Additionally production tubing 52 which does not require a gradual curve of production strings 46 for a through flowline operations can have a sharp bend, as shown since high profile guide base 24 has been removed.

With this configuration of guide base 48, the well completion equipment or marine insert tree system 42 for the subsea well 10 has a low profile which minimizes possible damage by icebergs, anchors and fishing nets.

What is claimed is:

1. A subsea well completion apparatus for a subsea well having a subsea well bore comprising an anchor base adapted to be landed on bottom surrounding the subsea well bore, a conductor pipe adapted to be cemented in the well bore, a production string extending through said conductor pipe and gradually bending on a radius to accept through flowline tools from a vertical position in said conductor pipe below said anchor base to a substantially horizontal position a short distance above the anchor base, and a low profile tree system for connecting to the production string and adapted to be located on and supported by said anchor base.

2. A subsea well completion apparatus according to claim 1 including means for locking the upper end of said conductor pipe to said anchor base.

3. A subsea well completion apparatus according to claim 1 including a guide base landed on said anchor base and supporting said tree system.

4. A subsea well completion apparatus according to claim 3 wherein said guide base includes an upwardly facing funnel supported within and extending below the upper surface of said anchor base, and said production string starting its bend below said funnel.

5. A subsea well completion apparatus comprising an anchor base landed on bottom surrounding a subsea well bore and having a neck extending downward in the well bore, a conductor pipe having its upper end latched to said neck and extending downward in said well bore, a funnel-up guide base landed on said anchor base with its funnel in the neck of the anchor base, and a production string in said well bore and bending gradually toward horizontal, said production string starting its bend at a position completely below the funnel and being horizontal a short distance above said guide base.

6. A subsea well completion apparatus comprising an anchor base landed on the bottom surrounding a subsea well bore and having a neck extending downward in the well bore, a conductor pipe having its upper end latched to said neck and extending downward in said well bore, a funnel-up guide base landed on said anchor base with its funnel in the neck opening of the anchor base, a first production string in said well bore and bending gradually toward the horizontal, said first production string starting its bend below the funnel and being horizontal a short distance above said guide base, and a second production string in said well bore and bending toward horizontal, said production string starting its sharp bend immediately above the funnel.

* * * * *